US006289878B1

(12) United States Patent
Blass

(10) Patent No.: US 6,289,878 B1
(45) Date of Patent: Sep. 18, 2001

(54) ENGINE HAVING MULTIPLE PUMPS DRIVEN BY A SINGLE SHAFT

(75) Inventor: James R. Blass, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/354,394

(22) Filed: Jul. 15, 1999

(51) Int. Cl.[7] ..... F02M 37/04; F01P 5/10

(52) U.S. Cl. ..... 123/509; 123/41.47

(58) Field of Search ..... 123/509, 41.44, 123/41.47, 196 R, 41.46, 446

(56) References Cited

U.S. PATENT DOCUMENTS

| | | | | |
|---|---|---|---|---|
| 3,904,318 | | 9/1975 | Born et al. . | |
| 3,926,157 | * | 12/1975 | Lippitsch | 123/41.47 |
| 4,177,786 | * | 12/1979 | Leitermann et al. | 123/196 R |
| 4,648,363 | | 3/1987 | Kronich . | |
| 4,700,671 | | 10/1987 | Matsushita . | |
| 4,703,726 | | 11/1987 | Sekiya et al. . | |
| 4,721,185 | | 1/1988 | Weigle . | |
| 5,063,895 | | 11/1991 | Ampferer . | |
| 5,168,703 | | 12/1992 | Tobias . | |
| 5,195,479 | * | 3/1993 | Hasetoh et al. | 123/41.47 |
| 5,540,203 | | 7/1996 | Foulkes et al. . | |
| 5,894,830 | * | 4/1999 | Blass et al. | 123/446 |

FOREIGN PATENT DOCUMENTS

| | | |
|---|---|---|
| 24 39 555 A | 2/1976 | (DE) . |
| 36 16 672 A1 | 11/1987 | (DE) . |
| 0 961 015 A2 | 12/1999 | (EP) . |
| 1 256 460 A | 6/1961 | (FR) . |
| 2 012 354 A | 7/1979 | (GB) . |
| 2 322 416 A | 8/1998 | (GB) . |

OTHER PUBLICATIONS

Japan Abstract—Publication #01177420, Date Jul. 13, 1989; Applicant: Suzuki Motor Co. Ltd.
Japan Abstract—Publication #60216032; Date Oct. 29, 1985; Applicant: Yanmar Diesel Engine Co Ltd.

* cited by examiner

*Primary Examiner*—Andrew M. Dolinar
*Assistant Examiner*—Arnold Castro
(74) *Attorney, Agent, or Firm*—Liell & McNeil

(57) ABSTRACT

An engine comprises an engine housing. A first engine fluid sub-system that includes a first pump and the engine housing defining a first fluid passage is also included in the engine. The engine also includes at least one additional engine fluid sub-system that includes a second pump and the engine housing defining a second fluid passage. A rotating shaft is at least partially positioned in the engine housing, the first pump and the second pump.

17 Claims, 1 Drawing Sheet

ENGINE HAVING MULTIPLE PUMPS DRIVEN BY A SINGLE SHAFT

This invention was made with U.S. Government support under Contract No. DE-FC05-97OR22605 awarded by the Department of Energy. The Government has certain rights in this invention.

TECHNICAL FIELD

The present invention relates generally to engines having multiple pumps, and more particularly to engines having multiple pumps driven by a single shaft.

BACKGROUND ART

Traditionally, for engines employing multiple fluid sub-systems, a separate driving mechanism is required to power the fluid pump included in each fluid sub-system. Therefore, for engines including a fuel injection system, an engine lubricating system and an additional system, three shafts were a necessity. To make engines more compact and reliable, it is desirable to reduce the number of shafts required for operation of the pumps included in the various engine fluid sub-systems.

The present invention is directed to overcoming one or more of the problems set forth above.

SUMMARY OF THE INVENTION

An engine includes an engine housing. A first engine fluid sub-system that includes a first pump and the engine housing defining a first fluid passage is also included in the engine. The engine also includes at least one additional engine fluid sub-system that includes a second pump and the engine housing defining a second fluid passage. A rotating shaft is at least partially positioned in the engine housing, the first pump and the second pump.

BEST MODE FOR CARRYING OUT THE INVENTION

Figure 1:
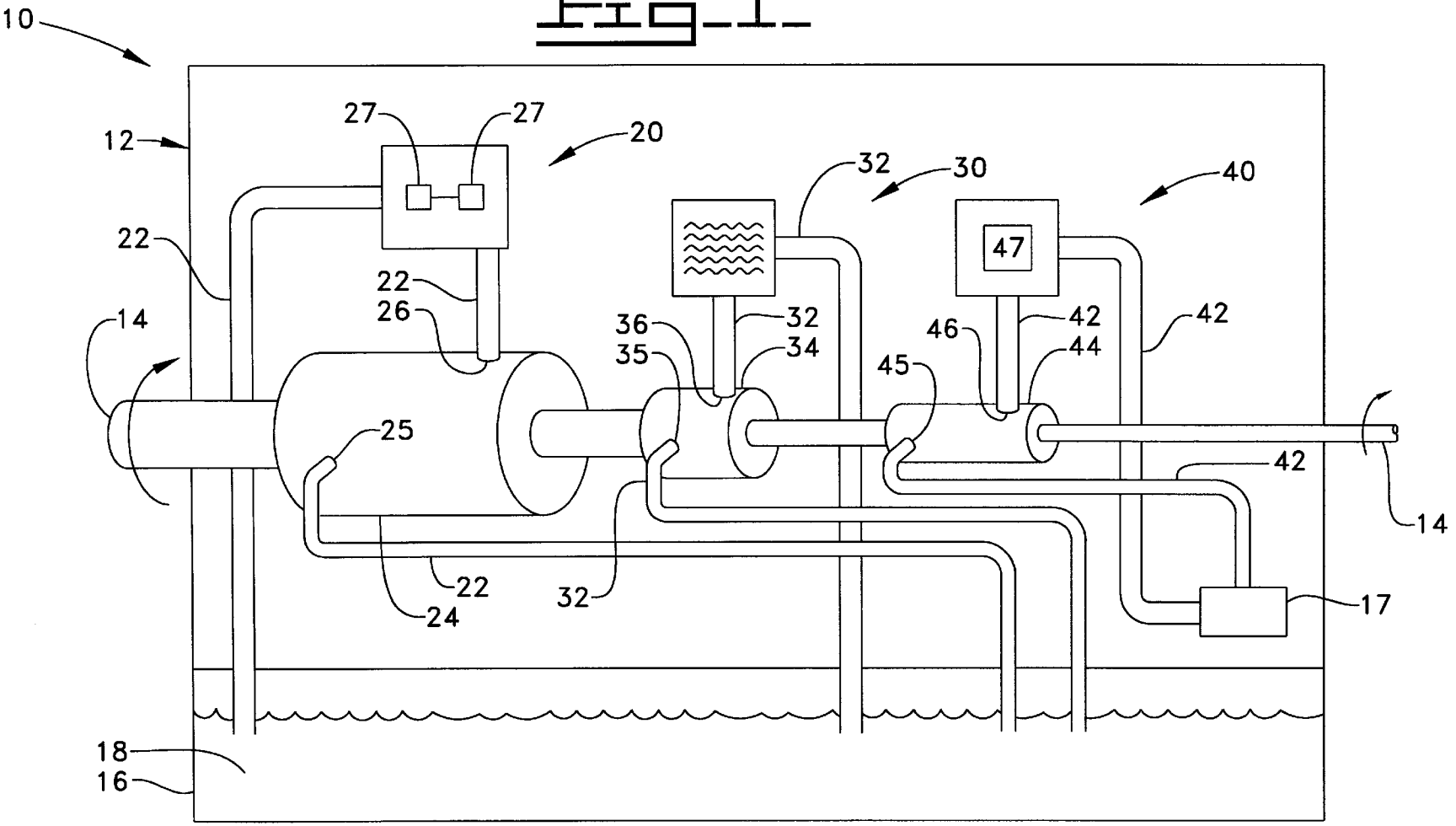
FIG. 1 is a diagrammatic representation of an engine according to the present invention.

Referring now to FIG. 1, there is shown a diagrammatic representation of an engine 10 according to the present invention. Engine 10 includes an engine housing 12 which contains various engine components well known to those skilled in the art. Among those components that are at least partially contained in engine housing 12 are a first engine fluid sub-system 20, a second engine fluid sub-system 30, and a third engine fluid sub-system 40. It should be appreciated that first engine fluid sub-system 20, second engine fluid sub-system 30 and third engine fluid sub-system 40 are portions of the overall engine system. Engine housing 12 also defines a first fluid passage 22, a second fluid passage 32 and a third fluid passage 42, as well as an oil pan 16 which includes an amount of oil 18. Additionally, a rotating shaft 14 is preferably positioned at least partially in engine housing 12. Rotating shaft 14 is preferably driven by a crankshaft included in engine 10, but could also be gear driven, belt driven, or cam driven.

First engine fluid sub-system 20 is preferably a fuel injection system, but could be any fluid sub-system utilized by engine 10. At least a portion of first engine fluid sub-system 20 is attached to or positioned in engine housing 12 which defines first fluid passage 22. A portion of rotating shaft 14 is at least partially positioned in a first pump 24 that is included in first engine fluid sub-system 20. First pump 24 includes a first pump inlet 25 and a first pump outlet 26. If first engine fluid sub-system 20 is a fuel injection system, first pump 24 would be a high pressure pump. First pump 24 is preferably positioned in oil pan 16 such that an amount of oil 18 can enter first pump inlet 25. While first engine fluid sub-system 20 preferably uses engine lubricating oil, it should be appreciated that any other available engine liquid, such as distillate diesel fuel could be used as a working fluid. First engine fluid sub-system 20 also includes first fluid passage 22 which is in fluid communication with first pump outlet 25. First fluid passage 22 transports an amount of oil through first engine fluid sub-system 20 to perform work, such as actuating a hydraulically actuated fuel injector 27, and returns the same to oil pan 16 for recirculation.

Second engine fluid sub-system 30 is preferably an engine lubricating system, however, it should be appreciated that it could be any engine fluid sub-system. As with first engine fluid sub-system 20, at least a portion of second engine fluid sub-system 30 is attached to or positioned in engine housing 12 which defines second fluid passage 32. A portion of rotating shaft 14 is also at least partially positioned in a second pump 34 that is included in second engine fluid sub-system 30. If second engine fluid sub-system 30 is an engine lubricating system, second pump 34 is preferably a low pressure pump that is positioned in oil pan 16. As with first pump 24, second pump 34 includes a second pump inlet 35, which is preferably fluidly connected to oil pan 16, and a second pump outlet 36, that is preferably in fluid communication with second fluid passage 32. It should be appreciated that second pump outlet 36 could also be in fluid communication with first pump inlet 25. Second fluid passage 32 transports an amount of liquid to various components of second engine fluid sub-system 30 and then returns it to oil pan 16 for recirculation.

Third engine fluid sub-system 40 is preferably an engine cooling system. Once again, at least a portion of third engine fluid sub-system 40 is attached to or positioned in engine housing 12 which defines third fluid passage 42. Another portion of rotating shaft 14 is at least partially positioned in a third pump 44 that is included in second engine fluid sub-system 30. If third engine fluid sub-system 40 is an engine cooling system, then third pump 44 should be a water pump. Third pump 44 includes a third pump inlet 45 and a third pump outlet 46. Third pump inlet 45 is fluidly connected to a source of liquid 17 while third pump outlet 46 is in fluid communication with third fluid passage 42. For an engine cooling system, source of liquid 17 is preferably a source of water or other appropriate engine coolant liquid. Third fluid passage 42 transports an amount of liquid through third engine fluid sub-system 40 to perform work, such as circulation through an engine radiator 47, and returns the same to liquid source 17 for recirculation.

Industrial Applicability

Referring now to FIG. 1, engine 10 is activated in any of the usual manners known in the art. Ignition of engine 10 initiates rotation of rotating shaft 14. Recall that rotating shaft 14 is preferably driven by a crankshaft that is included in engine 10, but it could also be gear driven, belt driven, or cam driven. Revolution of rotating shaft 14 begins to drive first pump 24, second pump 34 and third pump 44, which in turn activates first engine fluid sub-system 20, second engine fluid sub-system 30 and third engine fluid sub-system 40, respectively. Recall that, for purposes of this illustration, first engine fluid sub-system 20 is a fuel injection system, second engine fluid sub-system 30 is an engine lubricating system and third engine fluid sub-system 40 is an engine cooling system.

When fuel injection system 20 is activated, first pump 24, which is a high pressure pump, begins pumping oil from oil pan 16 through first fluid passage 22 to the various fuel injection components such as a high pressure manifold and a plurality of hydraulically actuated fuel injectors 27. Similarly, as engine lubricating system 30 is activated, second pump 34, which is a low pressure pump, begins pumping oil from oil pan 16 through second fluid passage 32 to lubricate the various moving components of the engine. For both fuel injection system 20 and engine lubricating system 30, oil is returned to oil pan 16 via first fluid passage 22 and second fluid passage 32 when work is complete in the respective systems.

Concurrent to the activation of fuel injection system 20 and engine lubricating system 30 is the initiation of engine cooling system 40. Once again, third pump 44, which is a water pump, is activated by the rotation of rotating shaft 14 and begins to pump an amount of coolant from liquid source 17. This liquid is moved through the various components of engine cooling system 40 via third fluid passage 42 to cool the various components of engine 10.

It should be appreciated that several alterations of the present invention are possible. For instance, while first engine fluid sub-system 20, second engine fluid sub-system 30, and third engine fluid sub-system 40 have been described as a fuel injection system, an engine lubricating system and an engine cooling system, respectively, this need not be the case. Engine fluid sub-systems 20, 30, and 40 could be any fluid sub-systems required by the engine. Alternatives include a turbo charger, engine compression release brakes, engine gas exchange valves, or a fuel supply system. Similarly, it should be appreciated that the number of engine fluid sub-systems could be greater or less than the three illustrated, once again to be determined by the needs of the engine.

If engine fluid sub-systems 20, 30, and 40 are a different combination of systems than those described, it should be appreciated that first pump 24, second pump 34 and third pump 44 would be in fluid communication with alternate fluid sources. For instance, while second pump 34 has been illustrated as being in fluid communication with the same source of liquid as first pump 24, it could instead be in fluid communication with a different source of liquid, such as a source of distillate diesel fuel or brake fluid. In this alternative case, second fluid passage 32 would contain an amount of liquid that is different than that transported in first fluid passage 22. Likewise, while third pump 44 has been shown as being fluidly connected to a source of liquid other than oil pan 16, it should be appreciated that it could in fact be in fluid communication with the same source of liquid as first engine fluid sub-system 20 and second engine fluid sub-system 30. Further, it should be appreciated that each engine fluid sub-system 20, 30, and 40 could be in fluid communication with a separate source of liquid.

While several variations of the present invention are possible, it is preferable that first pump 24, second pump 34 and third pump 44 be engineered to produce appropriate outputs throughout the operating range of the engine. This is preferable because pumps 24, 34, and 44 are all driven at the same RPM, which varies with the engine operating conditions. For instance, for the described systems, a rise in engine RPM will result in more injections, more lubricant circulation and more coolant circulation. Conversely, a decrease in engine RPMs will result in less injection, a smaller amount of engine lubricant being circulated and a smaller amount of engine coolant being circulated. This coupling of pump performance to RPM should be taken into account when sizing pumps and selecting engine fluid sub-systems to include with the technology of the present invention.

It should be understood that the above description is intended for illustrative purposes only, and is not intended to limit the scope of the present invention in any way. For instance, while three engine fluid sub-systems have been illustrated, it should be appreciated that any number of sub-systems that could be supported by the engine could have been included. Additionally, while a fuel injection system and an engine lubricating system are preferable as the first and second engine fluid sub-systems, it should be appreciated that other engine fluid sub-systems could be substituted. Thus, those skilled in the art will appreciate the various modifications could be made to the disclosed embodiments without departing from the intended scope of the present invention, which is defined in terms of the claims set forth below.

What is claimed is:

1. An engine comprising:

an engine housing;

a first engine fluid sub-system including a first pump and said engine housing defining a first fluid passage;

at least one additional engine fluid sub-system including a second pump and said engine housing defining a second fluid passage a rotating shaft positioned at least partially in said engine housing, said first pump and said second pump, said first engine fluid sub-system being a fuel injection system;

said at least one additional engine fluid sub-system including an engine lubricating system; and said first fluid passage and said second fluid passage each include an amount of oil.

2. The engine of claim 1 wherein said at least one additional fluid sub-system includes a third engine fluid sub-system that includes a third pump and said engine housing defining a third fluid passage; and said rotating shaft being at least partially positioned in said third pump.

3. An engine comprising:

an engine housing;

a fuel injection system including a first pump and said engine housing defining a first fluid passage;

an engine lubricating system including a second pump and said engine housing defining a second fluid passage;

at least one additional engine fluid sub-system including a third pump and said engine housing defining a third fluid passage;

a rotating shaft being at least partially positioned in said engine housing, said first pump, said second pump and said third pump;

at least one of said fuel injection system and said engine lubricating system including a hydraulically controlled device; and an amount of oil being included in one of said first fluid passage and said second fluid passage.

4. The engine of claim 3 further comprising a crankshaft; and said rotating shaft is driven by said crankshaft.

5. The engine of claim 4 wherein said first pump is a high pressure pump and said second pump is a low pressure pump.

6. The engine of claim 5 wherein an amount of oil is included in both said first fluid passage and said second fluid passage.

7. The engine of claim 6 wherein said first pump and said second pump are positioned in an oil pan, said oil pan being defined by said engine housing.

8. The engine of claim 5 wherein said third fluid passage includes a liquid that is different from oil.

9. An engine comprising:

an engine housing;

a fuel injection system being attached to said engine housing and including a high pressure pump and said engine housing defining a first fluid passage;

a first amount of oil flowing through said first fluid passage;

an engine lubricating system being attached to said engine housing and including a low pressure pump and said engine housing defining a second fluid passage;

a rotating shaft being at least partially positioned in said engine housing, said high pressure pump and said low pressure pump; and a second amount of oil flowing through said second fluid passageway.

10. The engine of claim 9 further comprising a crankshaft; and said rotating shaft is driven by said crankshaft.

11. The engine of claim 10 wherein said engine housing includes an oil pan; and said high pressure pump and said low pressure pump are positioned in said oil pan.

12. The engine of claim 11 wherein said fuel injection system includes a plurality of hydraulically actuated fuel injectors.

13. The engine of claim 12 further comprising a third engine fluid sub-system attached to said engine housing and including a third pump and said engine housing defining a third fluid passage; and said rotating shaft being at least partially positioned in said third pump.

14. A method of driving multiple pumps on a single shaft comprising:

providing a fuel injection system having a first pump and a first fluid passage;

providing an engine lubricating system having a second pump and a second fluid passage;

positioning a rotating shaft at least partially in said first pump and said second pump; and turning said rotating shaft with a crankshaft.

15. The method of claim 14 including the steps of providing a third engine fluid sub-system having a third pump and a third fluid passage; and positioning said rotating shaft at least partially in said third pump.

16. The method of claim 15 wherein said first pump is a high pressure pump and said second pump is a low pressure pump; and positioning inlets of said high pressure pump and said low pressure pump in an oil pan included in said engine housing.

17. The method of claim 16 including the steps of circulating a first fluid in said first fluid passage; and circulating a second fluid in said third fluid passage, wherein said second fluid is different than said first fluid.

* * * * *